US007600346B2

(12) United States Patent
Meeks

(10) Patent No.: US 7,600,346 B2
(45) Date of Patent: Oct. 13, 2009

(54) ENTRYWAY SYSTEM INCLUDING A THRESHOLD ASSEMBLY

(75) Inventor: James W. Meeks, Eaton, OH (US)

(73) Assignee: Quanex Corporation, Houston, TX (US)

( * ) Notice: Subject to any disclaimer, the term of this patent is extended or adjusted under 35 U.S.C. 154(b) by 0 days.

(21) Appl. No.: 12/048,507

(22) Filed: Mar. 14, 2008

(65) Prior Publication Data

US 2008/0222961 A1 Sep. 18, 2008

Related U.S. Application Data

(60) Provisional application No. 60/906,971, filed on Mar. 14, 2007, provisional application No. 60/913,652, filed on Apr. 24, 2007.

(51) Int. Cl.
*E06B 1/70* (2006.01)

(52) U.S. Cl. ..... 49/471; 52/179; 52/211; 49/467

(58) Field of Classification Search ..... 52/213, 52/179, 211, 309, 204.1; 49/467, 471, 476, 49/469, 476.1
See application file for complete search history.

(56) References Cited

U.S. PATENT DOCUMENTS

| | | | | |
|---|---|---|---|---|
| 448,501 | A | 3/1891 | Bussert | |
| 586,467 | A | 7/1897 | Vogel | |
| 635,656 | A | 10/1899 | Chastain | |
| 719,672 | A | 2/1903 | Jewell | |
| 2,570,336 | A | 10/1951 | Fouts | |
| 3,851,420 | A | 12/1974 | Tibbetts | |
| 4,055,917 | A | 11/1977 | Coller | |
| 4,310,991 | A * | 1/1982 | Seely | 49/470 |
| 4,686,793 | A | 8/1987 | Mills | |
| 4,691,487 | A * | 9/1987 | Kessler | 52/209 |
| 4,831,779 | A | 5/1989 | Kehrli et al. | |
| 5,067,279 | A * | 11/1991 | Hagemeyer | 49/471 |
| 5,136,814 | A | 8/1992 | Headrick | |
| 5,179,804 | A | 1/1993 | Young | |
| 5,956,909 | A * | 9/1999 | Chou | 52/209 |
| 6,637,158 | B2 | 10/2003 | Bennett | |
| 6,763,639 | B2 | 7/2004 | Bennett et al. | |
| 6,789,358 | B2 | 9/2004 | Procton et al. | |
| 6,789,359 | B2 | 9/2004 | Bauman et al. | |
| 6,883,279 | B2 * | 4/2005 | Fukuro et al. | 52/209 |
| 7,263,808 | B2 | 9/2007 | Massey et al. | |

(Continued)

*Primary Examiner*—Richard E Chilcot, Jr.
*Assistant Examiner*—Anthony N Batosik
(74) *Attorney, Agent, or Firm*—Howard & Howard Attorneys PLLC

(57) ABSTRACT

A threshold assembly is disposed below a closure. The threshold assembly includes a sill having a first end and a second end spaced from each other and having an entry portion sloping downwardly from a proximate end to a distal end between the first and second ends. A pair of jamb pedestals are disposed at the first and second ends of the sill, respectively. Each jamb pedestal supports a jamb spaced above the sill. A first wall extends upwardly from the proximate end of the entry portion and a second wall extends upwardly from the sill and along the first wall to define a channel extending longitudinally between the jamb pedestals. The first wall defines an opening which establishes fluid communication from the channel to the entry portion of the sill between the jamb pedestals for directing water from the channel away from the threshold assembly along the entry portion.

29 Claims, 8 Drawing Sheets

U.S. PATENT DOCUMENTS

2003/0005644 A1 1/2003 Reithmeyer et al.
2006/0150521 A1 7/2006 Henry et al.
2008/0110100 A1* 5/2008 Heppner ..... 49/471

* cited by examiner

ENTRYWAY SYSTEM INCLUDING A THRESHOLD ASSEMBLY

The subject patent application claims priority to and all the benefits of U.S. Provisional Patent Application Ser. No. 60/906,971 which was filed on Mar. 14, 2007; and U.S. Provisional Patent Application Ser. No. 60/913,652 which was filed on Apr. 24, 2007; the specification of both expressly incorporated herein by reference.

BACKGROUND OF THE INVENTION

1. Field of the Invention

The present invention relates to an entryway system including a threshold assembly for disposition below a closure, such as a door.

2. Description of the Related Art

Entryway systems seal an interior of a structure, such as a commercial or residential building, from wind, rain/snow, incidental water, debris, etc. present in an exterior of the structure, i.e., outside. Entryway systems include a pair of vertical jambs, a threshold assembly extending between the jambs, and a closure, e.g., a door hingedly mounted to one of the jambs or a door slideably coupled to the threshold assembly. The threshold assembly is disposed below the door when the door is in a closed position.

In storms including wind and rain, the rain hits the door and runs down the door toward the threshold assembly. In storms with high wind and heavy rains, a large amount of water runs down the door. Also, high wind can force the water between the door and the jambs where the water drains downwardly. In such instances, the water accumulates at the threshold assembly and may undesirably seep between the door and the threshold and into the interior of the structure.

Such water seepage has many detrimental effects. For example, water can cause damage to wooden components of the entryway system and the building by causing the wood to warp and/or rot. Also, water can corrode or rust metal components of the entryway system and the building. In addition, the water can foster mold growth on components of the entryway system and the building.

It would be desirable to manufacture a threshold assembly that effectively manages water to prevent the detrimental effects of water seepage described above.

SUMMARY OF THE INVENTION AND ADVANTAGES

The invention includes a threshold assembly for disposition below a closure. The threshold assembly comprises a sill having a first end and a second end spaced from each other and having an entry portion sloping downwardly from a proximate end to a distal end between the first and second ends. A first jamb pedestal is disposed at the first end of the sill and a second jamb pedestal is disposed at the second end of the sill with each jamb pedestal extending upwardly from the sill presenting a support surface spaced above the proximate end of the sill for supporting a jamb spaced above the sill. A first wall extends upwardly from the proximate end of the entry portion between the first and second jamb pedestals. A second wall extends upwardly from the sill and along the first wall between the first and second jamb pedestals to define a channel extending longitudinally between the first and second jamb pedestals. The first wall defines an opening which establishes fluid communication from the channel to the entry portion of the sill between the first and second jamb pedestals for directing water from the channel away from the threshold assembly along the entry portion.

The threshold assembly obstructs, retains, and then guides water away from the closure, i.e., the threshold assembly manages the water. As rain water hits the closure, the rain water runs down the closure toward the threshold assembly. The first wall prevents water from flowing from the entry portion of the sill beneath the closure. Further, the entry portion is sloped downwardly from the proximate end to the distal end to direct water away from the closure. The channel between the first and second walls collects water that seeps behind the first wall, e.g., water that is forced between the jamb and the door by high winds. Because the opening in the first wall establishes fluid communication from the channel to the entry portion of the sill, any water in the channel flows from the channel to the entry portion of the sill, where the water flows downwardly from the proximate end toward the distal end of the entry portion of the sill. In addition, because the jamb pedestals space the jambs from the sill, water flowing from the proximate end toward the distal end of the entry portion of the sill does not contact the jambs to prevent water damage to the jambs.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
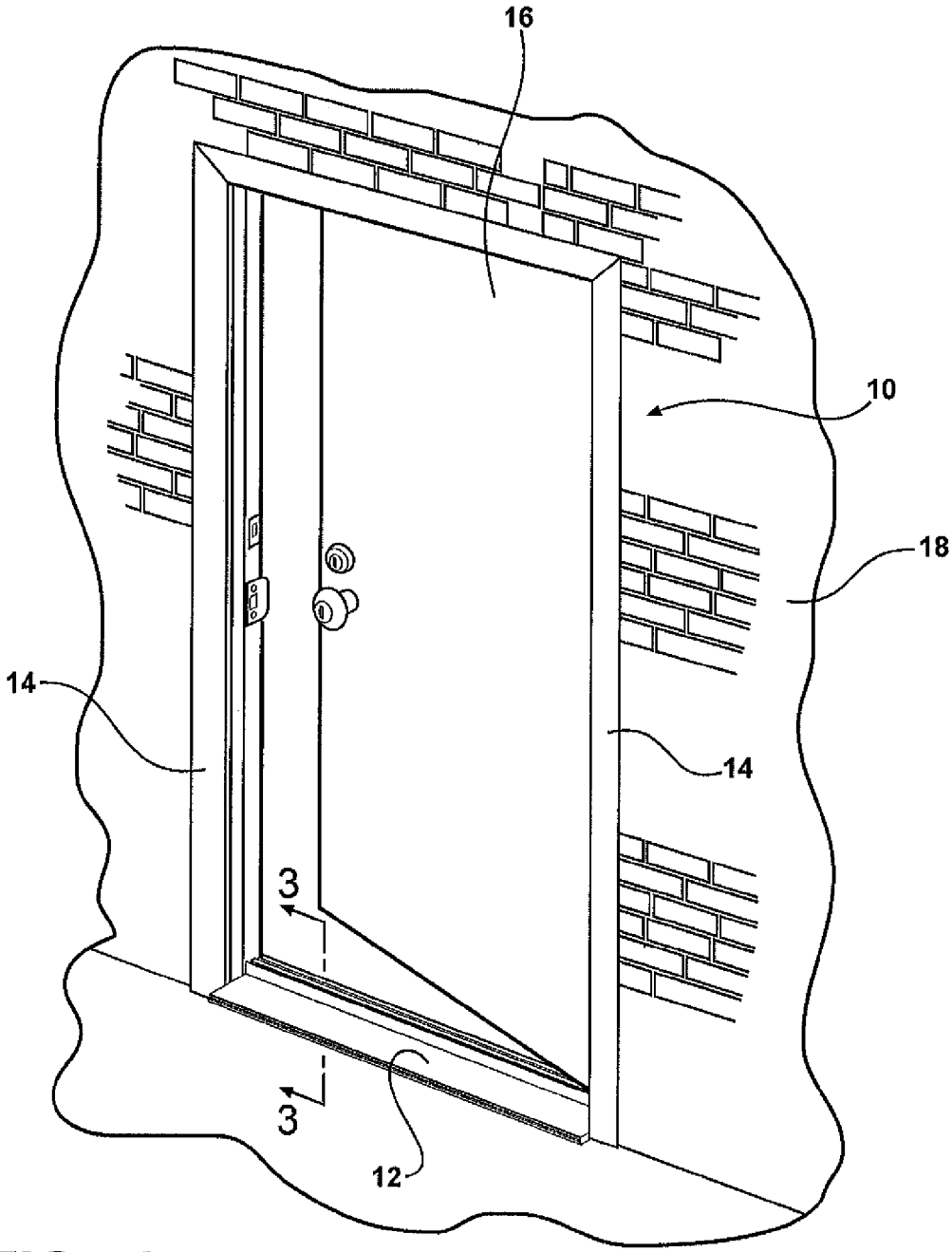
FIG. 1 is a perspective view of an entryway system.
Figure 2:
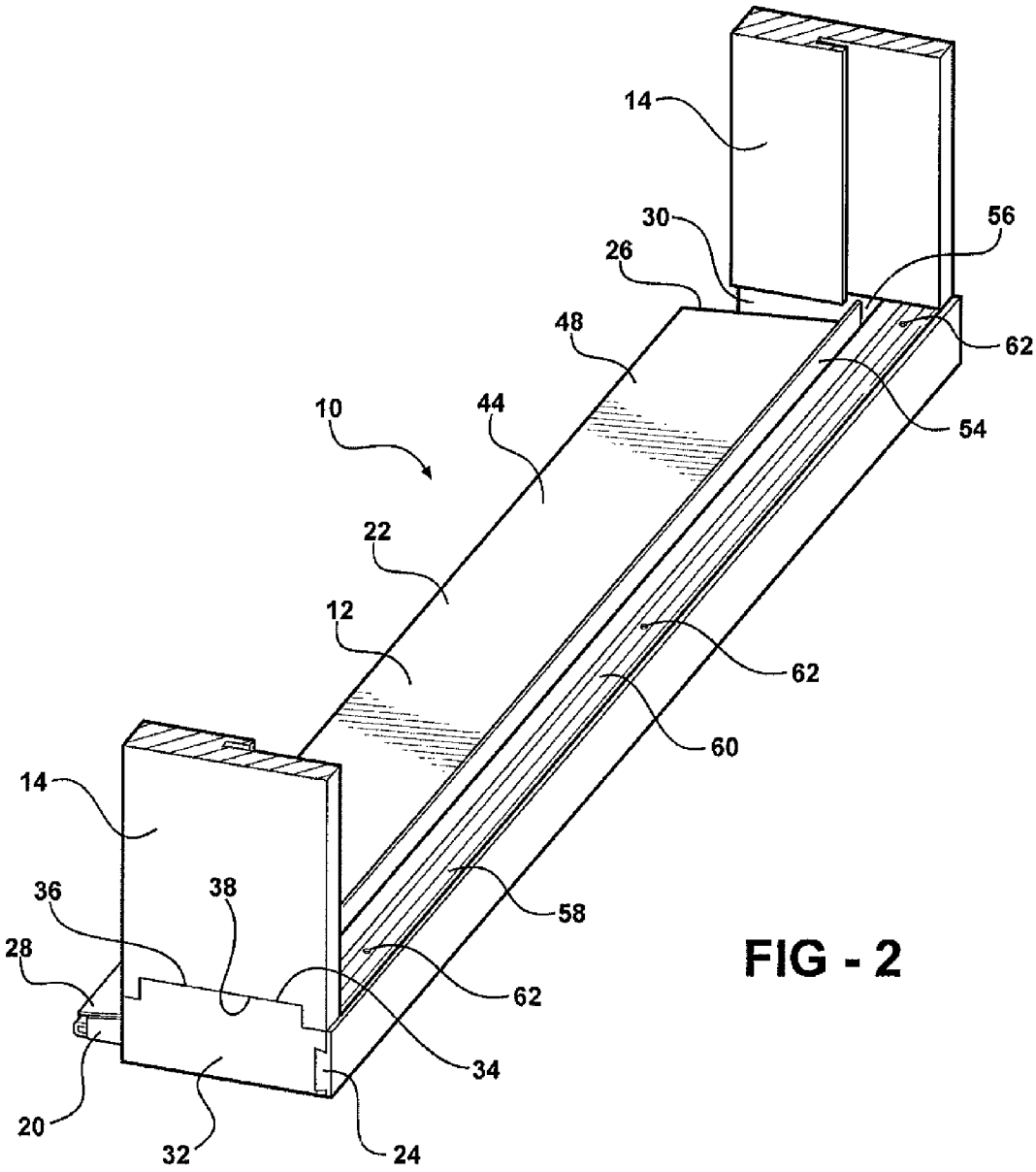
FIG. 2 is a perspective view of a portion of the entryway system including a threshold assembly and a pair of jambs extending upwardly from the threshold assembly.
Figure 3:
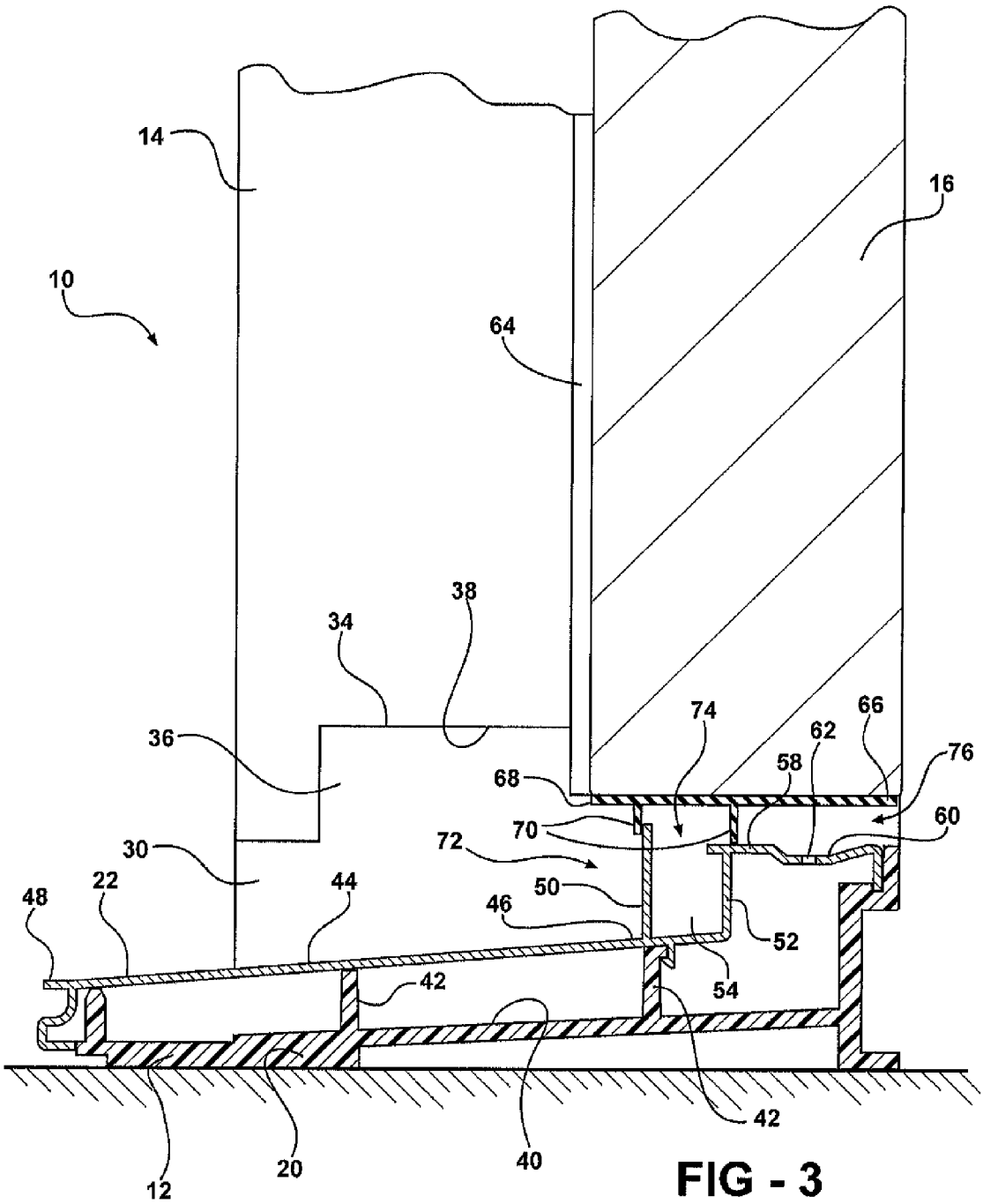
FIG. 3 is a cross-sectional view of a portion of the entryway system through Line 3 of FIG. 1 with a door of the entryway system in a closed position.

Referring to the Figures, wherein like numerals indicate corresponding parts throughout the several views, an entryway system is generally shown at 10. As shown in FIG. 1, the entryway system 10 includes a threshold assembly 12, a pair of jambs 14 extending upwardly from the threshold assembly 12, and a closure, e.g., a door 16, extending between the jambs 14. The door 16 is shown only in FIGS. 1-3 and is not shown in the other Figures. The door 16 shown in FIGS. 1-3 is hingedly mounted to one of the jambs 14; however, it is appreciated that the entryway system 10 can instead include a sliding door system including, for example, a sliding door and a fixed panel. The threshold assembly 12 is used in conjunction with rest of the entryway system 10 to seal an interior of a building 18, such as a commercial or residential building, from wind, rain/snow, incidental water, debris, etc. present in an exterior of the building 18, i.e., outside. In FIG. 3, the exterior of the building is shown to the left of the door 16 and the interior of the building is shown to the right of the door. Although the threshold assembly 12 assists in sealing the building 18 from debris and wind, one primary function of the threshold assembly 12 is to obstruct, retain, and then guide or direct water (rain/snow or incidental) to the exterior of the building 18. In other words, the threshold assembly 12 "manages" the flow of water. For example, in storms including high wind and heavy rains, the rain hits the door 16 and runs down the door 16 toward the threshold assembly 12. The threshold assembly 12 of the present invention manages the water running down the door 16.

Figure 4:
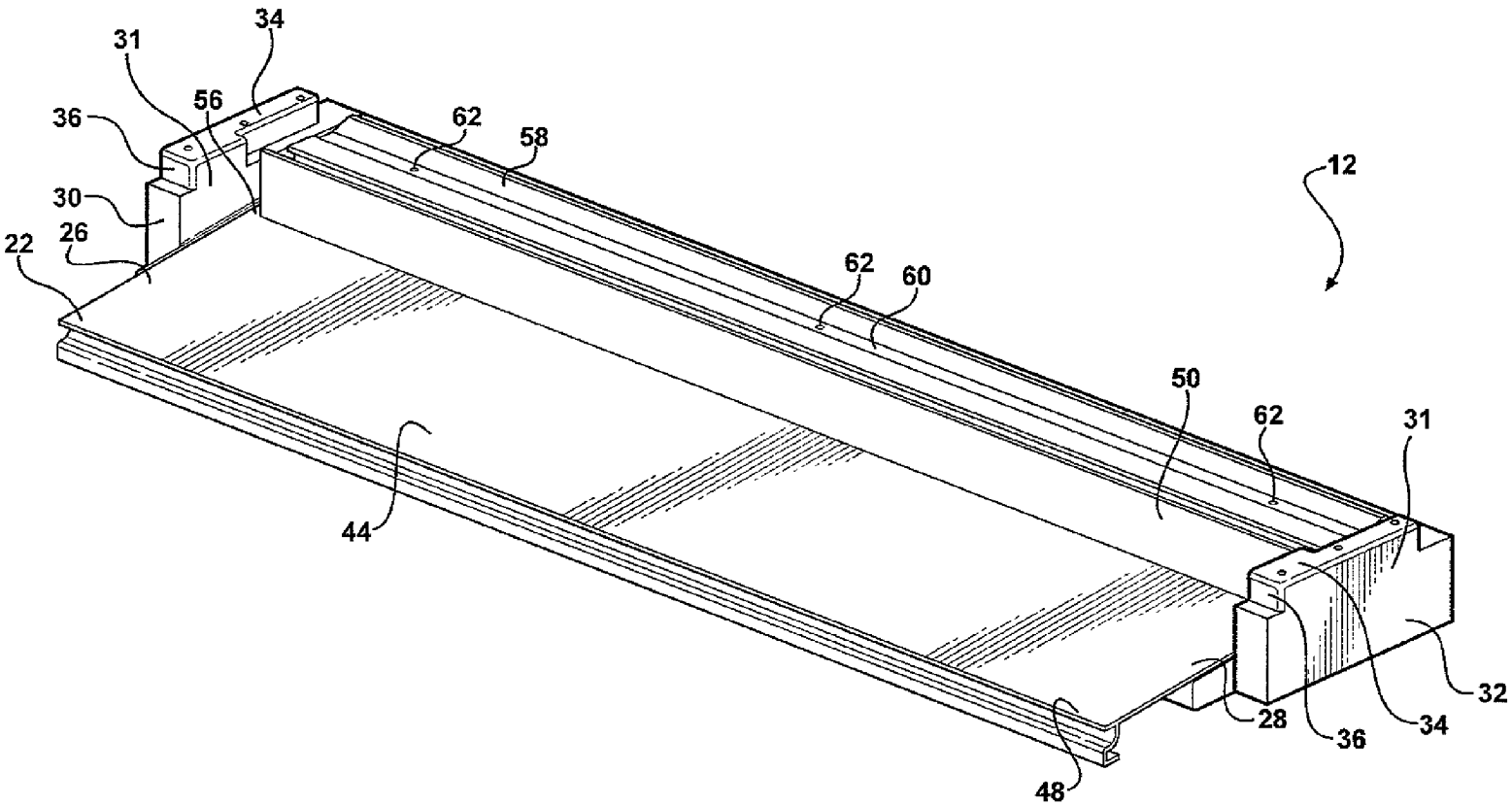
FIG. 4 is a perspective view of the threshold assembly including a base, a pair of jamb pedestals, and a sill.
Figure 5:
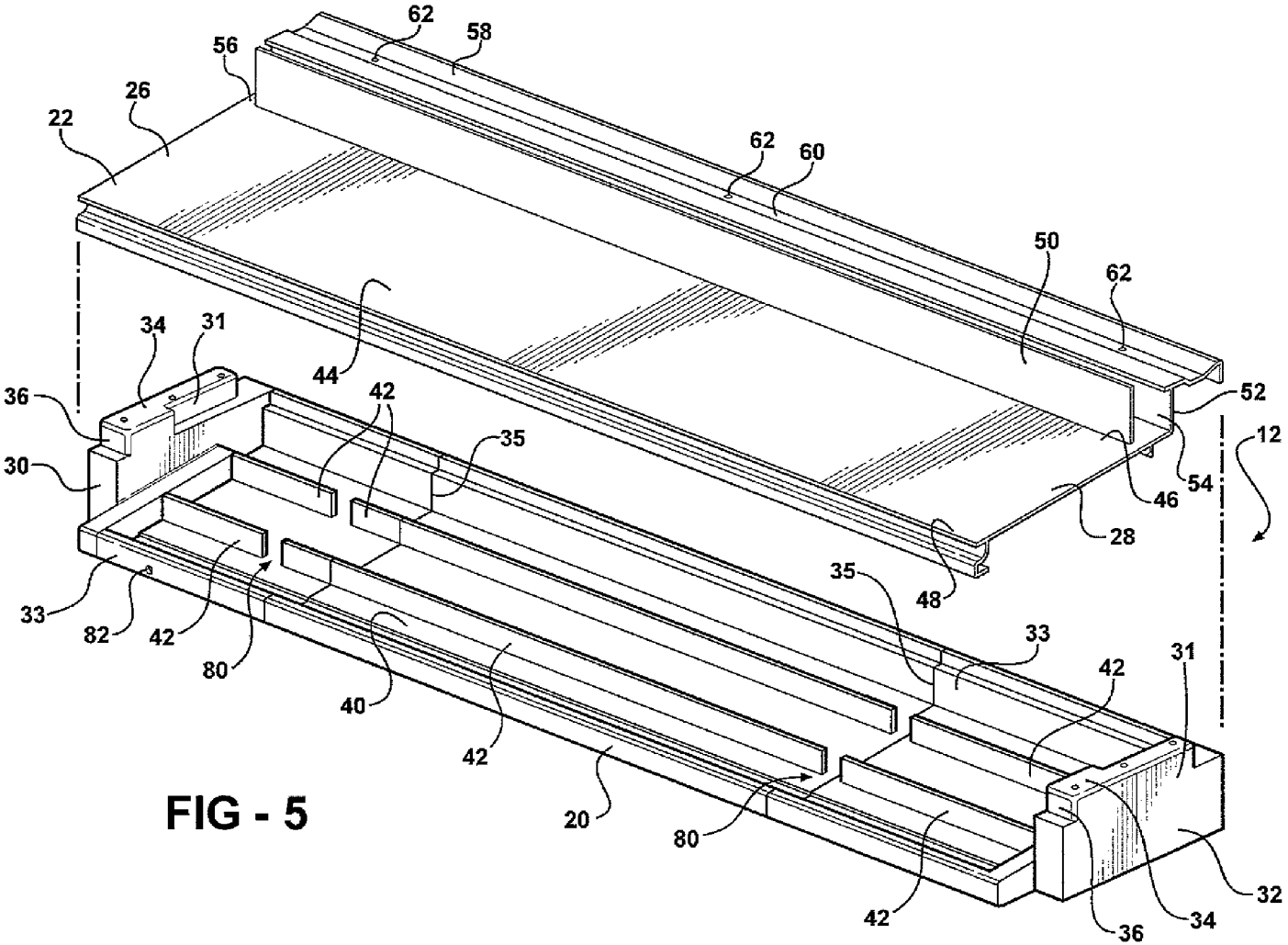
FIG. 5 is an exploded view of the threshold assembly.
Figure 6:
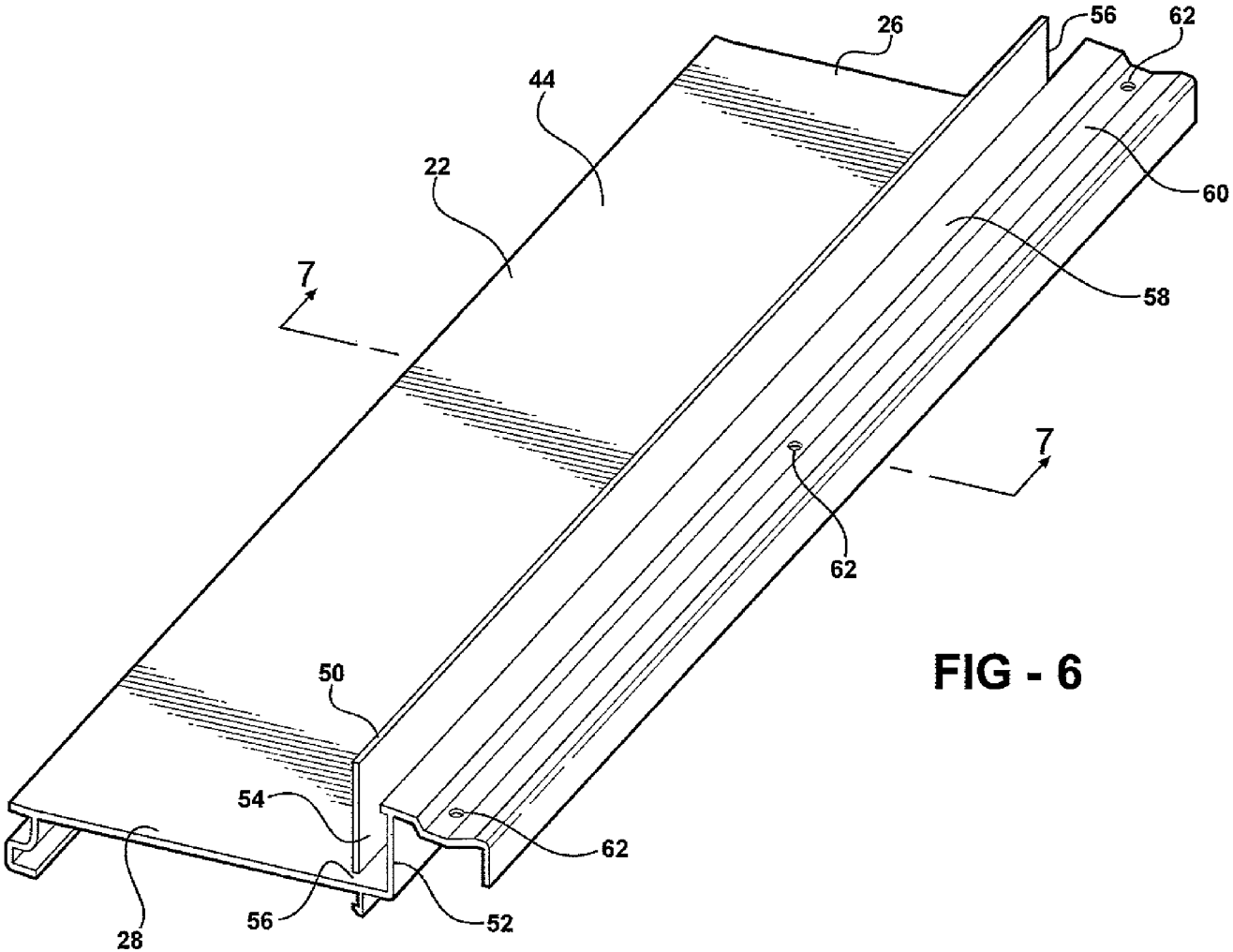
FIG. 6 is a view a perspective view of the sill.
Figure 7:
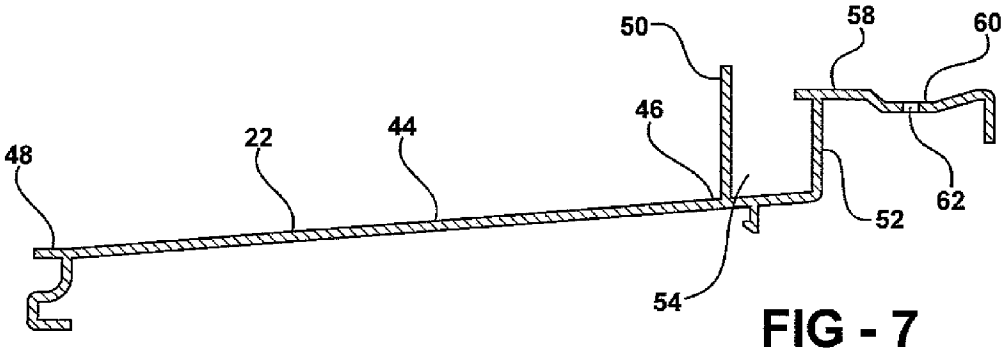
FIG. 7 is a cross-sectional view of the sill through Line 7 of FIG. 6.

As best shown in FIGS. 4 and 5, the threshold assembly 12 includes a base 20 and a sill 22 supported by the base 20 below the door 16. The base 20 is typically mounted to a floor or subfloor of the building 18. At one end, the base 20 defines a generally C-shaped portion. The C-shaped portion encapsulates a trim component 24, i.e., engages and retains the trim component 24. At an opposite end, the base 20 is situated in the entryway system 10 near, in, and/or adjacent to the exterior of the building 18.

The sill 22 extends between a first end 26 and a second end 28. A first jamb pedestal 30 is disposed at the first end of the sill 22 and a second jamb pedestal 32 is disposed at the second end of the sill 22. The base 20 extends from the first jamb pedestal 30 to the second jamb pedestal 32. The base 20 and the jamb pedestals 30, 32 are typically formed of the same material and are typically formed of a plastic, polymer, or other water resistant materials. However, it should be appreciated that the base 20 and the jamb pedestals 30, 32 can be formed of other suitable rigid materials and that the base 20 can be formed of a different material than the jamb pedestals 30, 32.

As shown in FIG. 5, each jamb pedestal 30, 32 includes a pedestal portion 31 and an extension portion 33. The pedestal portion 31 extends upwardly from the building above the sill 22. The extension portion 33 extends from the pedestal portion 31 to the base 20 below the sill 22. The pedestal portion 31 and the extension portion 33 are typically integrally formed with each other, i.e., the pedestal portion 321 and the extension portion 33 are formed as a single continuous unit.

The base 20 and the jamb pedestals 30, 32 can be formed separately and subsequently united. In such a configuration, the extension portion 33 and the base 20 are joined along a water impervious joint 35. The water impervious joint 35 prevents water from leaking between the extension portion 33 and the base 20. During heavy rain and wind, for example, water runs down the jambs 14 and the jamb pedestals 30, 32. The water can seep between the jamb pedestals 30, 32 and the sill 22. Because the pedestal portion 31 and the extension portion 33 are integral, water cannot leak between the pedestal portion 31 and the extension portion 33. Further, because the extension portion 33 and the base 20 are joined along the water impervious joint 35, water cannot leak between the extension portion 33 and the base 20. In an alternative embodiment, the base 20 and the jamb pedestals 30, 32 can also be formed together as a single unit, for example, by injection molding.

When formed separately, for example, the jamb pedestals 30, 32 and the base 20 can be connected by sonic welding the extension portion 33 to the base 20 to form the water impervious joint 35. As another example, in the configuration where the jamb pedestals 30, 32 are formed by injection molding, the extension portion 33 can be overmolded onto the base 20 as the jamb pedestals 30, 32 are injection molded to form the water impervious joint 35. As yet another example, the extension portion 33 can be mechanically fastened, e.g., with screws and with sealant disposed between the extension portion 33 and the base 20 to form the water impervious joint 35. It is to be appreciated that the jamb pedestals extension portion 33 can connected to the base 20 via screws, adhesive, glazing tape, gaskets, and the like, and any combination thereof to form the water impervious joint 35.

For example, the base 20 can be formed by extrusion and the jamb pedestals 30, 32 can be formed by injection molding. Injection molding is conducive to forming the shape of the jamb pedestals 30, 32, including a drain path 80 between support walls 42, as described further below. Further, a long piece of extruded stock can be extruded in the configuration of the base 20 and the base 20 can be subsequently cut to size from the extruded stock. The water impervious joint 35 is typically located along the support walls 42 of the base 20. In such a configuration, the base 20 can be cut from the extruded stock and no alterations to the base 20 are required before the base 20 is joined to the jamb pedestals 30, 32. It is appreciated, however, that the water impervious joint 35 can be located at any distance from the pedestal portion 31, and two such locations are shown in FIG. 5 illustrative purposes, i.e., one along the support walls 42 of the base 20 and another along the drain path 80.

Each jamb pedestal 30, 32 extends upwardly from the sill 22 presenting a support surface 34 spaced above the sill 22 for supporting the jamb 14 spaced from the sill 22. Specifically, as shown in FIGS. 2 and 3, one jamb 14 is supported on the support surface 34 of the first jamb pedestal 30 and the other jamb 14 is supported on the support surface 34 of the second jamb pedestal 32. The jambs 14 are typically formed of wood and are typically susceptible to water damage. Because the jambs 14 are spaced from the sill 22, water on the sill 22 does not come into contact with the jambs 14 to prevent water damage to the jambs 14. The jamb pedestals 30, 32 are shaped to receive and support the door jambs 30, 32. For example, the jamb pedestal 30, 32 establishes a dado connection with the jambs 14. Specifically, in the configuration shown in FIG. 2, each jamb pedestal 30, 32 includes a boss 36 and each jamb 14 defines a notch 38 receiving the boss 36.

As shown in FIG. 3, the base 20 includes a sloped floor 40 and the support walls 42 extend upwardly from the sloped floor 40 to support an underside of the sill 22. It is to be appreciated that the base 20 can include any number of support walls 42 without departing from the nature of the present invention. The sill 22 is mounted on top of the base 20 and is, more specifically, typically snapped or hooked onto the base 20.

The sill 22 functions as the top of the threshold assembly 12 and is typically manufactured from aluminum by extrusion; however, it is appreciated that the sill 22 can be formed of any suitable rigid material and by any process without departing from the nature of the present invention. As best shown in FIGS. 3-7, the sill 22 includes an entry portion 44 that is oriented in the entryway system 10 to be near, in, and/or adjacent to the exterior of the building 18. The entry portion 44 slopes downwardly away from the door 16 to direct water away from the door 16. Specifically, the entry portion 44 slopes downwardly from a proximate end 46 to a distal end 48 between the first and second ends 26, 28. The sill 22 is shaped to accept an extender (not shown), if necessary and as understood by those skilled in the art. The sill 22 also includes a flange for hooking into the base 20 as shown in the Figures.

A first wall 50 extends upwardly from the proximate end 46 of the entry portion 44 between the first and second jamb pedestals 30, 32 and a second wall 52 extends upwardly from the sill 22 and along the first wall 50 between the first and second jamb pedestals 30, 32. The second wall 52 is spaced from the first wall 50 opposite the first wall 50 from the entry portion 44. Both the first and second walls 50, 52 extend vertically upward from the sill 22 to assist in blocking the wind, rain/snow, incidental water, debris, etc. More specifically, the first and second walls 50, 52 divert water from the top of the threshold assembly 12. It should be appreciated that the first and second walls 50, 52 can be formed as a single unit with the sill 22 or can be formed separately from the sill 22 and subsequently attached to the sill 22.

The first and second walls 50, 52 define a channel 54 extending longitudinally between the first and second jamb pedestals 30, 32 for directing water from the channel 54 away from the threshold assembly 12 along the entry portion 44. A channel 54 bottom extends between the first and second walls 50, 52. The channel 54 bottom typically slopes downwardly from the second wall 52 to the first wall 50 and is typically aligned with the proximate end 46 of the entry portion 44. In other words, the channel 54 bottom intersects the first wall 50 at the proximate end 46 of the entry portion 44. The channel 54 bottom can also extend along a common slope with the entry portion 44 of the sill 22. In another embodiment, the first and second wall 52*s* can intersect each other in a V-shape.

The first wall 50 defines an opening 56 which establishes fluid communication from the channel 54 to the entry portion 44 of the sill 22 between the first and second jamb pedestals 30, 32. As described further below, the opening 56 directs water from the channel 54 away from the threshold assembly 12 along the entry portion 44. It is to be appreciated that the first wall 50 can define a plurality of such openings 56. As best shown in FIGS. 2, 4, and 5, the first wall 50 is spaced from the first jamb pedestal 30 such that the first wall 50 defines the opening 56 between the first wall 50 and the first jamb pedestal 30. In addition, the first wall 50 is spaced from the second jamb pedestal 32 such that the first wall 50 defines another opening 56 between the first wall 50 and the second jamb pedestal 32. It is to be appreciated that the opening 56 is not limited to a location between the first wall 50 and the jamb pedestal 30, 32, but may be defined by and located along any portion of the first wall 50 such that water is directed through the opening 56 from the channel 54 to the entry portion 44. As appreciated by one skilled in the art, the opening 56 is configured to encourage the flow of water from the channel 54 to the entry portion 44 and to discourage the flow of water from the entry portion 44 into the channel 54.

A platform 58 extends from the second wall 52 between the first and second jamb pedestals 30, 32 in a direction away from the entry portion 44. The platform 58 is disposed above the proximate end 46 of the entry portion 44, i.e., the platform 58 is disposed at a higher vertical elevation than the proximate end 46 of the sill 22. The platform 58 defines a groove 60 and a hole 62 along the groove 60. The hole 62 is in fluid communication with the base 20, where the water is managed as described further below.

The door 16 is rotatable about one of the jambs 14 between an opened and a closed position. The door 16 is shown in the opened position in FIG. 1. FIG. 3 is a cross-sectional view from perspective of Line 3 of FIG. 1 with the door in the closed position. In the closed position, the door 16 typically seals against the jambs 14. Weatherstripping 64 is disposed between the door 16 and the jambs 14 directing water downwardly between the door 16 and the jambs 14 and preventing the water from entering an interior of the building 18. The weatherstripping 64 is shown in FIG. 3. It is appreciated that the weatherstripping 64 can be mounted to the door 16, to the jambs 14, or both the door 16 and the jambs 14 can include weatherstripping 64.

As shown in FIG. 3, a door sweep 66 is mounted to the door 16 and interacts with the first wall 50 and the platform 58. The door sweep 66 extends across a bottom edge of the door 16 and rests on top of the sill 22 adjacent the groove 60 of the platform 58 when the door 16 is in the closed position. Further, a portion of the door sweep 66 rests on and seals against the first wall 50, i.e., creating a water-tight seal between the door sweep 66 and the first wall 50. The door sweep 66 is, for example, formed of an elastomeric material for sealing against the first wall 50.

The door sweep 66 includes a body 68 and fins 70 extending from the body 68 for sealing against the first wall 50 and the platform 58. In such an embodiment, the fins 70 resiliently extend downwardly such that the fins 70 may resiliently deform and slide over the first wall 50 and the platform 58 when the door 16 is moved between the open and closed positions. It is appreciated that the door sweep 66 may include any number of fins 70 without departing from the nature of the present invention. It is also appreciated that the door sweep 66 may have no fins without departing from the nature of the present invention. For example, in such an embodiment, the body of the door sweep 66 may seal against the first wall 50.

A first water defense mechanism 72 includes the door sweep 66 and the first wall 50 for preventing water from migrating past the first wall 50 across the threshold assembly 12, i.e., the door sweep 66 and the first wall 50 provide a first defense to prevent water from entering from the exterior to the interior of the building 18. The first wall 50 and the door sweep 66 prevent most or all water from entering from the exterior to the interior of the building 18. Specifically, water running down the door will be deflected by the door sweep 66 and the first wall 50 to the entry portion 44 of the sill 22, whereupon the water is directed by the entry portion 44 away from the door.

Notably, the first wall 50 extends vertically upward higher than the platform 58 to optimize water management. Specifically, when water is deflected by the door sweep 66 to the entry portion 44 of the sill 22, the deflected water momentarily puddles near the first wall 50 before it drains away from the door 16 along the entry portion 44. The first wall 50 is sufficiently high to prevent water from seeping between the first wall 50 and the door sweep 66 toward the interior of the building 18.

A second water defense mechanism 74 includes the second wall 52 and the channel 54 for preventing water from migrating past the second wall 52 across the threshold assembly 12, i.e., the second wall 52 and the channel 54 provide a secondary defense to prevent water from entering from the exterior to the interior of the building 18. Any water that may seep past the door sweep 66 and the first wall 50 is collected in the channel 54. In addition, water that seeps downwardly between the door 16 and the jambs can collect in the channel 54. Water that collects in the channel 54 is directed toward the exterior of the building 18 through the opening 56, as described above. In addition, or in the alternative, the channel 54 bottom defines at least one channel 54 weep hole (not shown) along the channel 54. The channel 54 weep hole directs water from the channel 54 to the base 20 below the sill 22 or directs the water to the exterior of the building 18 through, for example, a tube.

A third water defense mechanism 76 includes the platform 58, i.e., the groove 60 in the platform 58 provides a tertiary defense to prevent water from entering from the exterior to the interior of the building 18. Any water that reaches the platform 58 is collected in the groove 60. In addition, water that seeps downwardly between the door 16 and the jambs 14 can collect in the groove 60. The water is retained in the groove 60. Alternatively, the water is directed through the hole 62 in the platform 58 to the base 20. In such a configuration, water drains through the hole 62 to the base 20 below the channel weep hole or to the exterior of the building 18 through, for example, a tube (not shown).

Figure 8:
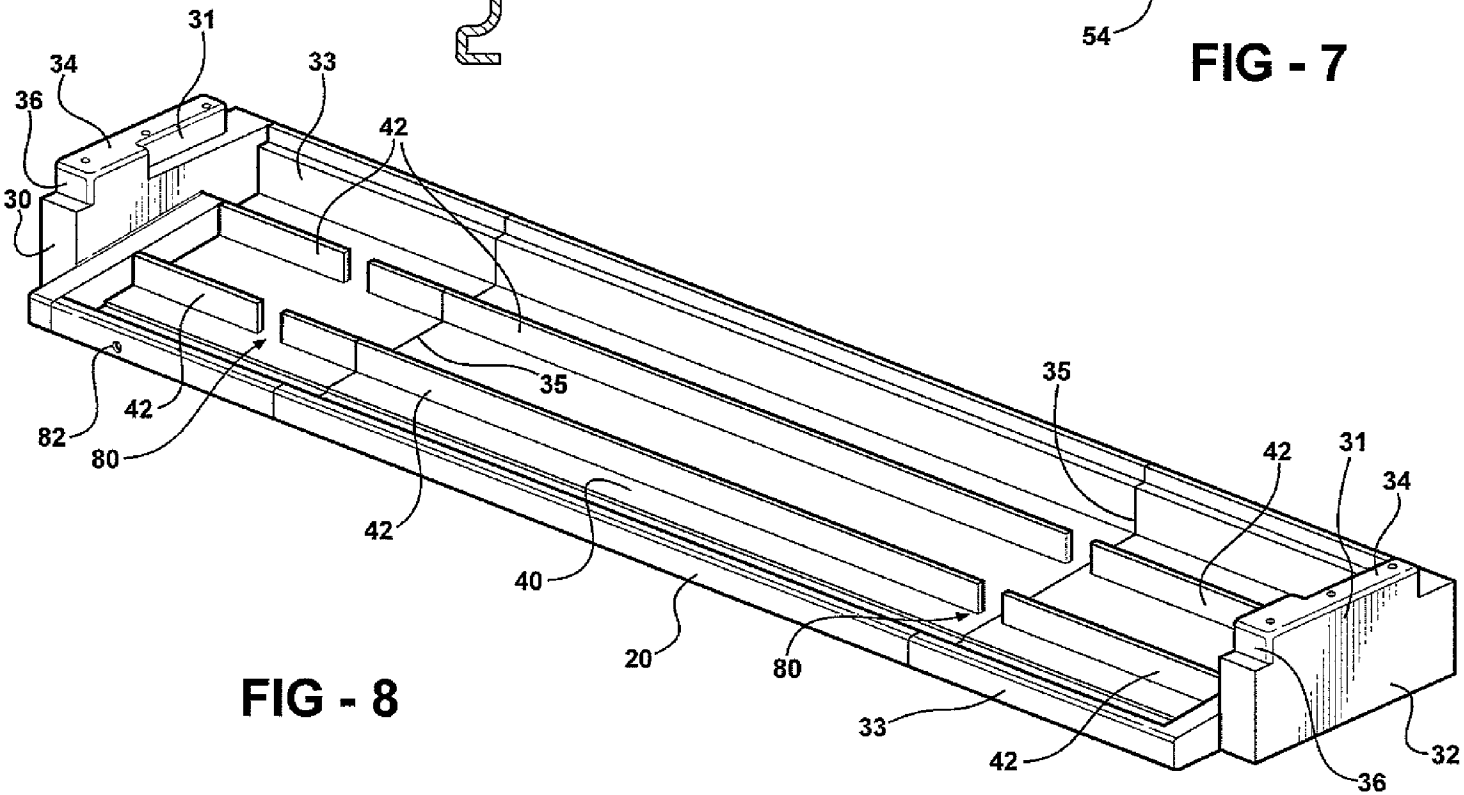
FIG. 8 is a perspective view of the base and the pair of jamb pedestals.
Figure 9:
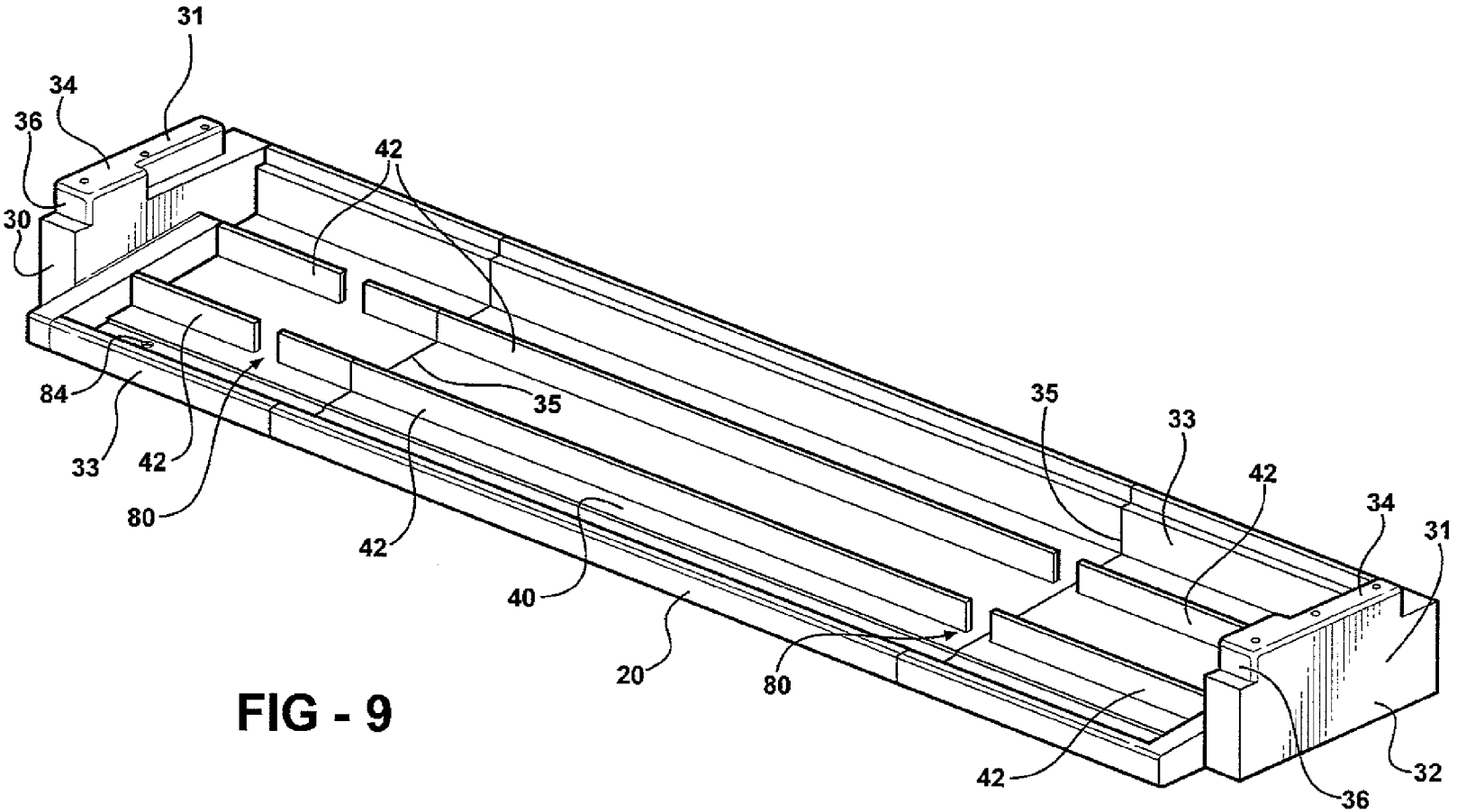
FIG. 9 is a perspective view of another embodiment of the base and the pair of jamb pedestals.

As shown in FIGS. 8 and 9, the support walls 42 define at least one drain path 80 for directing water along the sloped floor 40. The drain path 80 manages any water that may penetrate beneath the sill 22. For example, the hole 62 in the platform 58 and the channel weep hole in the channel 54 bottom are in fluid communication with the drain paths 80.

The support walls 42 and drain paths 80 of the base 20 establish an integral drain network for the threshold assembly 12.

Water that reaches the base 20 may be retained in the base 20. Alternatively, the water is directed to the exterior of the building 18. For example, the base 20 defines a slot 82 in communication with the drain paths 80 to allow water to drain from the base 20. In such a configuration, the water can seep away from the building 18 between the distal end 48 of the sill 22 and the base 20, or alternatively, can be directed from the slot 82 away from the base 20 with, for example, a passage or a tube. As appreciated by one skilled in the art, the slot 82 is configured to encourage the flow of water from the first base 20 channel 54 to the exterior and to discourage the flow of water from the exterior into the first base 20 channel 54. In addition, or in the alternative, the base 20 may define one or more base weep holes 84. In such a configuration, water drains through the base weep holes 84 to the exterior of the building 18 through, for example, a tube (not shown).

It is to be understood that many different designs, shapes, and styles of the sill can be used while keeping the base 20 disclosed herein constant. Likewise, may different designs, shapes, and styles of the base can be used while keeping the sill 22 disclosed herein a constant. This flexibility enables various door systems to be utilized with the threshold assembly 12 of the present invention.

The invention has been described in an illustrative manner, and it is to be understood that the terminology which has been used is intended to be in the nature of words of description rather than of limitation. Obviously, many modifications and variations of the present invention are possible in light of the above teachings, and the invention may be practiced otherwise than as specifically described.

What is claimed is:

1. A threshold assembly for disposition below a closure, said threshold assembly comprising:

a sill having a first end and a second end spaced from each other and having an entry portion sloping downwardly from a proximate end to a distal end between said first and second ends;

a first jamb pedestal disposed at said first end of said sill and a second jamb pedestal disposed at said second end of said sill with each jamb pedestal extending upwardly above said sill presenting a support surface spaced above said entry portion of said sill for supporting a jamb spaced above said entry portion;

a first wall extending upwardly from said proximate end of said entry portion between said first and second jamb pedestals;

a second wall extending upwardly from said sill and along said first wall between said first and second jamb pedestals to define a channel extending longitudinally between said first and second jamb pedestals;

said first wall defining an opening which establishes fluid communication from said channel to said entry portion of said sill between said first and second jamb pedestals for directing water from said channel away from said threshold assembly along said entry portion;

a base extending from said first jamb pedestal to said second jamb pedestal with said base supporting said sill;

wherein said base includes a sloped floor and support walls extending upwardly from said sloped floor to support an underside of said sill;

wherein said support walls define drain paths for directing water along said sloped floor; and a platform extending from said second wall between said first and second jamb pedestals in a direction away from said entry portion with said platform defining a groove and a hole along said groove with said hole in fluid communication with said drain paths of said base for directing water toward said drain paths.

2. A threshold assembly as set forth in claim 1 wherein said second wall is spaced from said first wall opposite said first wall from said entry portion with a channel bottom extending between said first and second walls.

3. A threshold assembly as set forth in claim 2 wherein said channel bottom slopes downwardly from said second wall to said first wall.

4. A threshold assembly as set forth in claim 3 wherein said channel bottom is vertically aligned with said proximate end of said entry portion.

5. A threshold assembly as set forth in claim 1 wherein said first wall is spaced from said first jamb pedestal with said first wall defining said opening between said first wall and said first jamb pedestal.

6. A threshold assembly as set forth in claim 1 wherein said second wall extends from said first jamb pedestal to said second jamb pedestal.

7. A threshold assembly as set forth in claim 1 wherein said base is joined to said first and second jamb pedestals along a water impervious joint.

8. A threshold assembly for disposition below a closure, said threshold assembly comprising:

a sill having an entry portion sloping downwardly from a proximate end to a distal end for preventing water from migrating across said threshold assembly;

a first water defense mechanism including a first wall extending upwardly from said proximate end of said entry portion for preventing water from migrating past said first wall across said threshold assembly;

a second water defense mechanism including a second wall positioned opposite said entry portion relative to said first wall and extending upwardly from said sill along said first wall defining a channel between said first and second walls for preventing water from migrating past said second wall across said threshold assembly;

a third water defense mechanism including a platform disposed above said proximate end of said entry portion and extending from said second wall in a direction away from said entry portion with said platform defining a groove for directing water along said groove; and a base disposed beneath said sill and having a sloped floor and support walls extending upwardly from said sloped floor with said support walls defining drain paths for directing water along said sloped floor;

said platform defining a groove and a hole along said groove with said hole in fluid communication with said drain paths of said base for directing water toward said drain paths.

9. A threshold assembly as set forth in claim 8 wherein said first wall defines an opening fluidly communicating said channel with said entry portion of said sill for directing water from said channel away from said threshold along said entry portion.

10. A threshold assembly as set forth in claim 9 wherein said sill has a first end and a second end and said entry portion slopes downwardly from said proximate end to said distal end.

11. A threshold assembly as set forth in claim 10 wherein said second wall is spaced from said first wall opposite said first wall from said entry portion with a channel bottom extending between said first and second walls and sloping downwardly from said second wall to said first wall.

12. A threshold assembly as set forth in claim 11 wherein said channel bottom is vertically aligned with said proximate end of said entry portion.

13. A threshold assembly as set forth in claim 8 wherein said support walls support an underside of said sill.

14. A threshold assembly as set forth in claim 8 further comprising a first jamb pedestal extending upwardly above said base and a second jamb pedestal spaced from said first jamb pedestal with each jamb pedestal extending upwardly above said sill presenting a support surface spaced above said entry portion of said sill for supporting a jamb spaced above said entry portion of said sill.

15. A threshold assembly as set forth in claim 14 wherein said entry portion slopes downwardly from said proximate end toward said distal end between said first and second jamb pedestals and wherein said first wall extends between said first and second jamb pedestals defining said opening between said first and second jamb pedestals and said second wall extends from said first jamb pedestal to said second jamb pedestal.

16. A threshold assembly as set forth in claim 15 wherein said base is joined to said first and second jamb pedestals along a water impervious joint.

17. An entryway system comprising:

a threshold assembly including a sill for disposition below a door;

said sill having a first end and a second end spaced from each other and having an entry portion sloping downwardly from a proximate end to a distal end between said first and second ends;

a first jamb pedestal disposed at said first end of said sill and a second jamb pedestal disposed at said second end of said sill with each jamb pedestal extending upwardly above said sill presenting a support surface spaced above said proximate end of said sill;

a first jamb supported on said support surface of said first jamb pedestal;

a second jamb supported on said support surface of said second jamb pedestal;

a first wall extending upwardly from said proximate end of said entry portion between said first and second jamb pedestals;

a second wall extending upwardly from said sill and along said first wall between said first and second jamb pedestals to define a channel extending longitudinally between said first and second jamb pedestals;

said first wall defining an opening which establishes fluid communication from said channel to said entry portion of said sill between said first and second jamb pedestals for directing water from said channel away from said threshold assembly along said entry portion;

a base disposed beneath said sill and having a sloped floor and support walls extending upwardly from said sloped floor with said support walls defining drain paths for directing water along said sloped floor; and a platform extending from said second wall in a direction away from said entry portion and defining a groove and a hole along said groove with said hole in fluid communication with said drain paths of said base for directing water toward said drain paths.

18. An entryway system as set forth in claim 17 wherein said first wall is spaced from said first jamb pedestal with said first wall defining said opening between said first wall and said first jamb pedestal and wherein said second wall extends from said first jamb pedestal to said second jamb pedestal.

19. An entryway system as set forth in claim 17 wherein said second wall is spaced from said first wall opposite said first wall from said entry portion with a channel bottom extending between said first and second walls.

20. An entryway system as set forth in claim 19 wherein said channel bottom is vertically aligned with said proximate end of said entry portion.

21. An entryway system as set forth in claim 17 wherein said support walls support an underside of said sill.

22. A threshold assembly for disposition below a closure, said threshold assembly comprising:

a sill having a first end and a second end spaced from each other and having an entry portion sloping downwardly from a proximate end to a distal end between said first and second ends;

a first jamb pedestal disposed at said first end of said sill;

a second jamb pedestal disposed at said second end of said sill;

each of said first and second jamb pedestals including a pedestal portion extending upwardly above said sill;

a first wall extending upwardly from said proximate end of said entry portion;

a second wall extending upwardly from said sill and along said first wall to define a channel;

a base extending from said first jamb pedestal to said second jamb pedestal with said sill supported by at least one of said first jamb pedestal, said second jamb pedestal, and said base;

each of said first and second jamb pedestals including an extension portion extending from said pedestal portion to said base and joined to said base along a water impervious joint;

a base disposed beneath said sill and having a sloped floor and support walls extending upwardly from said sloped floor with said support walls defining drain paths for directing water along said sloped floor; and a platform extending from said second wall in a direction away from said entry portion and defining a groove and a hole along said groove with said hole in fluid communication with said drain paths of said base for directing water toward said drain paths.

23. A threshold assembly as set forth in claim 22 wherein said pedestal portion and said extension portion are integrally formed with each other.

24. A threshold assembly as set forth in claim 23 wherein said first and second jamb pedestals are formed by molding and wherein said base is formed by extrusion.

25. A threshold assembly as set forth in claim 24 wherein said extension portions of said first and second pedestals extend from said pedestal portion to said base below said sill.

26. A threshold assembly as set forth in claim 24 wherein at least one of said base, said extension portion of said first pedestal, and said extension portion of said second pedestal includes a sloped floor and at least one support wall extending upwardly from said sloped floor to support an underside of said sill.

27. A threshold assembly as set forth in claim 22 wherein said second wall is spaced from said first wall opposite said first wall from said entry portion with a channel bottom extending between said first and second walls.

28. A threshold assembly as set forth in claim 27 wherein said channel bottom is vertically aligned with said proximate end of said entry portion.

29. A threshold assembly as set forth in claim 22 wherein said support walls support an underside of said sill.

* * * * *